US009609939B2

(12) United States Patent
Alvarez

(10) Patent No.: US 9,609,939 B2
(45) Date of Patent: Apr. 4, 2017

(54) DOUBLE ACTION PUSH BROOM

(71) Applicant: Salvador Alvarez, San Diego, CA (US)

(72) Inventor: Salvador Alvarez, San Diego, CA (US)

(73) Assignee: ALVAREZ & CASIAS, LLC

( * ) Notice: Subject to any disclaimer, the term of this patent is extended or adjusted under 35 U.S.C. 154(b) by 0 days.

(21) Appl. No.: 14/918,498

(22) Filed: Oct. 20, 2015

(65) Prior Publication Data

US 2016/0135577 A1 May 19, 2016

Related U.S. Application Data

(60) Provisional application No. 62/065,760, filed on Oct. 20, 2014.

(51) Int. Cl.

| | |
|---|---|
| ***A46B 7/02*** | (2006.01) |
| ***A46B 7/06*** | (2006.01) |
| ***B25G 3/30*** | (2006.01) |
| ***A46B 5/00*** | (2006.01) |
| ***A46B 9/02*** | (2006.01) |
| ***A46D 3/04*** | (2006.01) |
| ***A46D 3/08*** | (2006.01) |

(52) U.S. Cl.

CPC ..... *A46B 7/02* (2013.01); *A46B 5/0012* (2013.01); *A46B 7/06* (2013.01); *A46B 9/02* (2013.01); *A46D 3/04* (2013.01); *A46D 3/08* (2013.01); *B25G 3/30* (2013.01); *A46B 2200/302* (2013.01)

(58) Field of Classification Search

CPC ..... A46B 5/0012; A46B 7/02; A46B 7/06; A46B 9/00; A46B 9/02; A46B 15/00; A46B 2200/302

USPC ..... 15/106, 159.1, 171, 172, 201, 203

See application file for complete search history.

(56) References Cited

U.S. PATENT DOCUMENTS

| | | | | | |
|---|---|---|---|---|---|
| 1,616,484 | A | * | 2/1927 | Beynon | A46B 5/0025 15/167.2 |
| 2,588,601 | A | * | 3/1952 | Zavagno | A46B 5/0012 15/167.2 |
| 2,606,335 | A | * | 8/1952 | Wiesman | A46B 5/0025 15/160 |
| 2,631,320 | A | * | 3/1953 | Bressler | A46B 3/16 15/167.1 |

(Continued)

FOREIGN PATENT DOCUMENTS

| | | | |
|---|---|---|---|
| DE | 19831412 | * | 1/2000 |

*Primary Examiner* — Mark Spisich

(74) *Attorney, Agent, or Firm* — Gary L. Eastman, Esq.; Eastman & McCartney LLP

(57) ABSTRACT

The double action push broom of the present invention includes a dynamic double action dual brush head and a broom handle. The dynamic double action dual brush head includes two brush heads rotatably attached to a brush head base, allowing the brush heads to independently rotate about the axis in which it is rotatably attached to the brush head base. A mechanical device capable of storing and releasing energy is connected between the two brush heads, which is rigidly attached to the brush head base. The double action push broom stores kinetic energy in the form of potential energy in the mechanical energy storage device of the dynamic double action dual brush head during the sweeping stroke of the double action push broom. At the end of the sweeping stroke, the stored potential energy is converted into kinetic energy and rotates the dual brush, thereby providing an additional sweeping motion.

12 Claims, 7 Drawing Sheets

(56) References Cited

U.S. PATENT DOCUMENTS

| | | | | | |
|---|---|---|---|---|---|
| 2,796,620 | A * | 6/1957 | Bressler | A46B 5/0025 | 15/201 |
| 4,554,699 | A * | 11/1985 | Simmons | A46B 5/0025 | 15/1.7 |
| 2002/0152570 | A1 * | 10/2002 | Hohlbein | A46B 5/002 | 15/167.1 |
| 2005/0204498 | A1 * | 9/2005 | Saunders | A46B 7/02 | 15/172 |

* cited by examiner

DOUBLE ACTION PUSH BROOM

RELATED APPLICATIONS

This application claims the benefit of priority to U.S. Provisional Patent Application Ser. No. 62/065,760 filed on Oct. 20, 2014, entitled "Double Action Push Broom,".

FIELD OF THE INVENTION

The present invention relates generally to cleaning implements, and more specifically to brooms. The present invention is more particularly, though not exclusively useful as a push-type broom.

BACKGROUND OF THE INVENTION

The traditional broom is a cleaning implement widely used everywhere in the world. The basic structure of a broom has essentially been unchanged since it was first created. The traditional broom includes a handle and a brush head, and although technology has advanced, the basic structure has been maintained. Traditional brooms can be made with simple or complex, state of the art materials. A traditional broom may be made from a bundle of twigs tied together forming a stiff handle and a brush head, or made from state of the art materials such as thermoplastics, polymers and composites. Although the traditional broom is still widely used throughout the world, there have been slight variations to the traditional broom.

One variation of the traditional broom is the push-type broom created to handle heavy duty sweeping. The push-type broom, commonly referred to as the push broom, has a wide brush head with relatively short bristles, to which a handle is attached at an angle in the center of the brush head. The push broom brush is typically wider to cover more surface area. The bristles are stiff to allow the movement of heavier and larger amount of debris. The handle is angled to allow a user to apply a larger force to the broom enabling the push broom to push larger amounts of debris.

However, the push broom has its limitations and drawbacks. As result of its large brush head and the location of the broom handle at the center, the distribution of force across the brush head is unequal. This allows debris to escape from the bristles at the edges of the push broom. The debris also tends to lodge itself within the bristles of the push broom which then requires the user to exert additional force or physical interaction with the broom to dislodge the debris, such as tapping or scraping the brush head. Further, the bristles of the large brush head are spaced with large gaps that allow debris to slip past the bristles. This requires a user to continually push the push broom over the same area to ensure that all of the debris has been swept up and that no debris has slipped through the gaps.

In light of the above, it would be advantageous to provide a push broom with a dynamic brush head capable of providing an additional sweeping motion at the end of a user's sweeping stroke. It would further be advantageous to provide a push broom with a dynamic brush head capable of rotating from a first position to a second position where the dynamic brush head returns to the first position from the second position automatically.

SUMMARY OF THE INVENTION

The double action push broom of the present invention is designed to improve the effectiveness of a push broom by incorporating a dynamic double action dual brush head which automatically provides an additional sweeping motion at the end of a sweep stroke.

In a preferred embodiment, the double action push broom includes a dynamic double action dual brush head and a broom handle. The dynamic double action dual brush head includes two brush heads rotatably attached to a brush head base. This allows the brush head to rotate about the axis in which it is rotatably attached to the brush head base, with each brush head rotating independent of the other. A mechanical device capable of storing and releasing energy is connected between the two brush heads, which is rigidly attached to the brush head base. In the preferred embodiment, the mechanical device is a torsion spring with two moment arms, each arm extending to and contacting a corresponding brush head. The torsion spring is prefabricated with a spring constant and predetermined angle between the two moment arms. The angle of the moment arms maintains the brush heads at a brush head angle at all times. The use of a torsion spring as the mechanical energy storage device for the dynamic dual brush head is not meant to be limiting and it is contemplated that other types of mechanical energy storage devices may be used such as a leaf spring, a flat spring, a cantilever spring, or other various types of springs or spring-like materials without departing from the scope and spirit of the invention.

The double action push broom stores kinetic energy in the form of potential energy in the mechanical energy storage device of the dynamic double action dual brush head during the sweeping stroke of the double action push broom. During the sweeping motion, the dual brush head rotates to a maximum angle and is maintained until the sweeping stroke ends. At the end of the sweeping stroke, the stored potential energy is converted into kinetic energy and rotates the dual brush heads towards its initial position, thereby providing an additional sweeping motion. The additional sweeping motion pushes the debris swept by each brush head towards the center of the push broom and provides additional force to loosen any debris stuck in the bristles of the brush heads. Further, the additional sweeping motion sweeps the area where the sweeping stroke ends, ensuring any debris not picked up by the user's stroke is picked up by the sweeping motion of the dynamic double action dual brush head. The additional sweeping motion dramatically improves the effectiveness of the double action push broom over traditional push brooms.

In an alternative embodiment, the dynamic double action dual brush head includes a single brush head formed of an elastic material which enables each end of the brush head to move independently from one another. The choice of a proper elastic material allows for the brush head to flex as the double action push broom is being pushed during a sweeping stroke. The elastic material stores the kinetic energy in the form of potential energy through the flexure of the ends of the brush head. Once the sweeping stroke ends, the elastic material potential energy converts to kinetic energy and the brush head returns to its original shape, thereby providing the extra sweeping motion. As a result of the integrally formed brush head, there is only a single brush head; the dynamic double action dual brush head is a dynamic double action brush head.

BRIEF DESCRIPTION OF THE DRAWINGS

The nature, objects, and advantages of the present invention will become more apparent to those skilled in the art after considering the following detailed description in connection with the accompanying drawings, in which like reference numerals designate like parts throughout, and wherein.

DETAILED DESCRIPTION OF THE DRAWINGS

Figure 1:
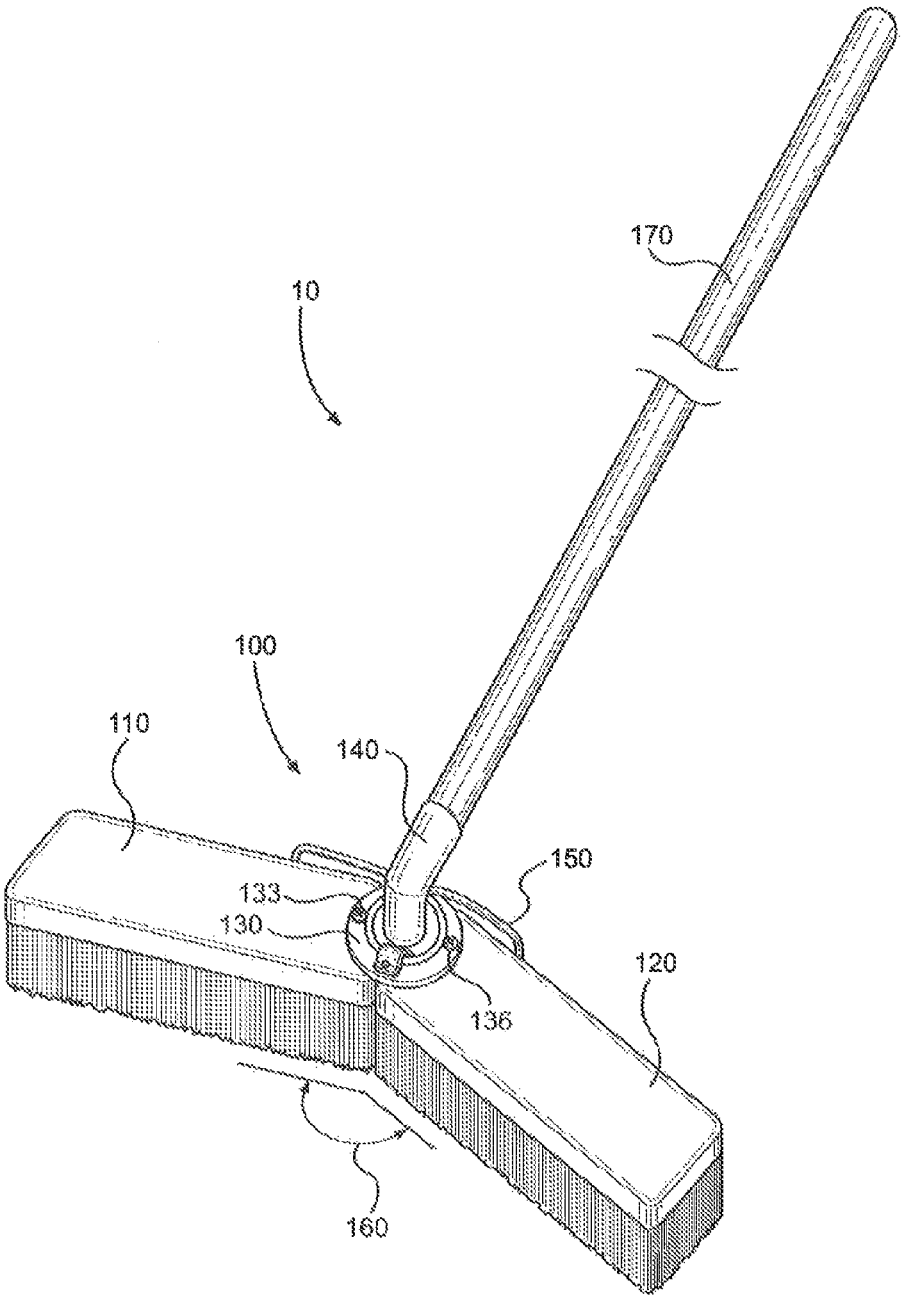
FIG. 1 is a front perspective view of the double action push broom of the present invention showing the dynamic double action dual brush heads.

Referring initially to FIG. 1, a preferred embodiment of the double action push broom of the present invention is shown and generally designated 10. The double action push broom includes a dynamic double action dual brush head 100 and a broom handle 170.

The dynamic double action dual brush head 100 includes two separate brush heads, a first brush head 110 and a second brush head 120 rotatably connected to a brush head base 130. A mechanical energy storage device is connected between the first brush head 110 and the second brush head 120 while rigidly connected to the brush head base 130. As shown, in the preferred embodiment the mechanical energy storage device is a torsion spring 150. It is contemplated that the torsion spring used as a mechanical energy storage device is not meant to be limiting and that various other types of mechanical energy storage devices may be used such as a flat spring, a leaf spring, a cantilever spring, or other types of mechanical energy storage devices without departing from the scope and spirit of the invention.

The first brush head 110 and the second brush head 120 is rotatably connected to the brush head base 130 by corresponding fasteners, 133 and 136 respectively. Fastener 133 provides an axis of rotation for the first brush head 110 and fastener 136 provides an axis of rotation for the second brush head 120. It is contemplated that bearings may be inserted into the first brush head 110 and the second brush head 120 where the fasteners 133 and 136, respectively, attach for smoother rotation. The torsion spring 150 is fixedly attached to the brush head base 130. The rest angle of the torsion spring 150 rotates the first brush head 110 and the second brush head 120 along each of their relative axis of rotation to a brush head angle 160. At rest, the brush head angle 160 is approximately equal to the resting angle of the torsion spring 150. The torsion spring 150 ensures the brush head angle 160 of the first brush head 110 and second brush head 120 returns to the rest angle when no force is acting on the first brush head 110 and the second brush head 120.

The rotation of the first brush head 110 and second brush head 120 rotates along their relative axis of rotation rotates which twists the torsion spring 150. When twisted, the torsion spring 150 exerts a force in the opposite direction of the rotation in proportion to the amount it is twisted. As a result, the torsion spring 150 stores the force as potential energy until it is converted into kinetic energy. When the force acting on the torsion spring 150 is no longer present, the torsion spring 150 converts the potential energy to kinetic energy. When this occurs, the kinetic energy from the torsion spring 150 rotates the first brush head 110 and second brush head 120, creating an additional sweeping motion which provides for a more effective push broom.

The additional sweeping motion of the dynamic double action dual brush head 100 provides an additional sweeping motion at the end of a user's sweeping stroke, which traditional push broom are not capable of providing. Further, the sweeping motion of the dynamic double action dual brush head 100 sweeps collected debris towards the center of the double action push broom 10 to allow better collecting of debris. Further the additional sweeping motion sweeps the area where the sweeping stroke ends, ensuring any debris not picked up by the user's stroke is picked up by the sweeping motion of the dynamic double action dual brush head 100. The additional sweeping motion dramatically improves the effectiveness of the double action push broom 10 over traditional push brooms which fail to adequately collect dirt at the edges of the push broom.

Figure 2:
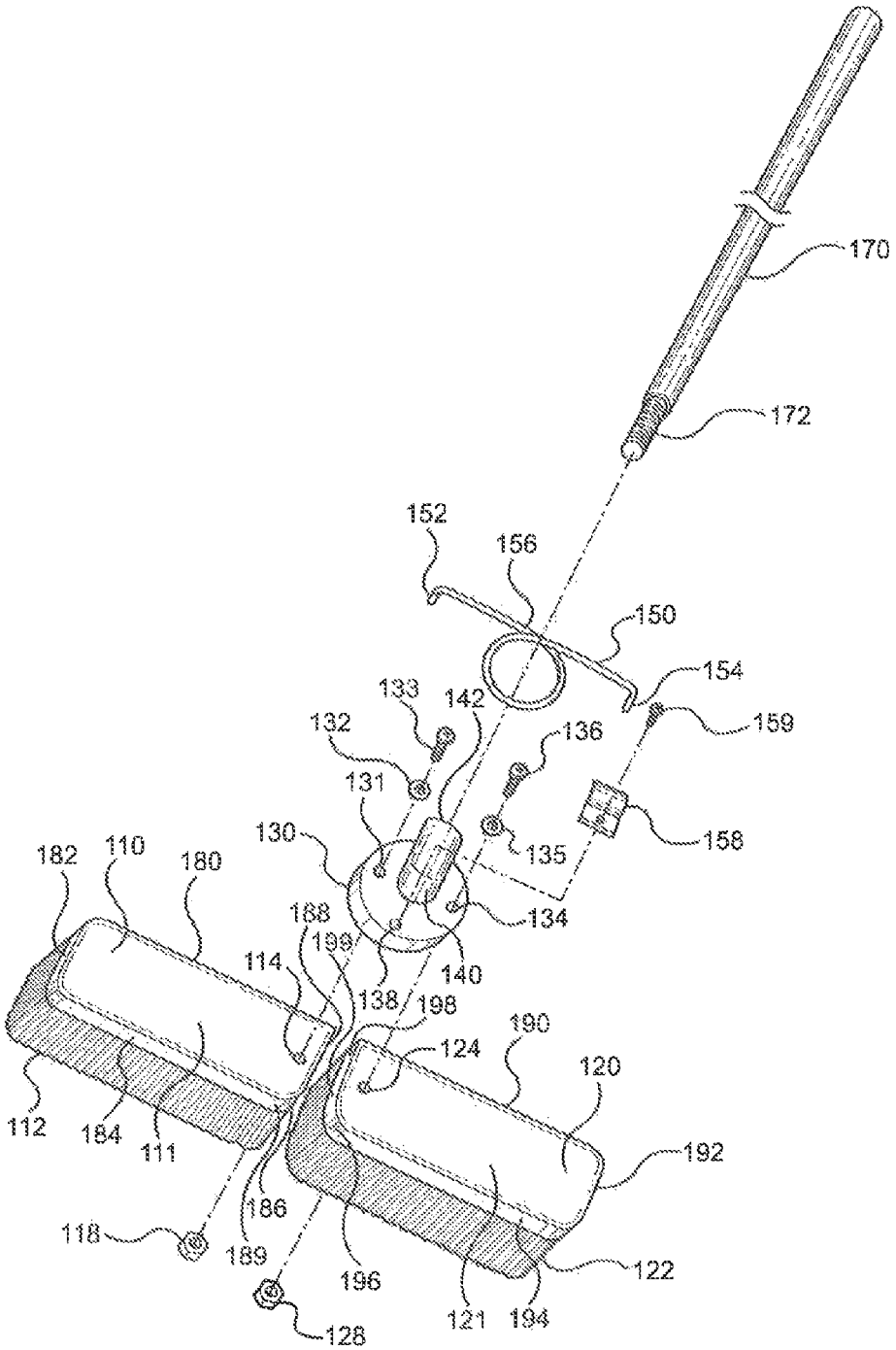
FIG. 2 is an exploded view of the double action push broom showing the individual parts which make up the present invention.

Referring now to FIG. 2, an exploded view of the preferred embodiment of the double action push broom 10 of the present invention is shown. The double action push broom 10 consists of a dynamic double action dual brush head 100 and a broom handle 170.

The dynamic double action dual brush head 100 includes two separate brush heads, a first brush head 110 and a second brush head 120 rotatably connected to a brush head base 130.

In the preferred embodiment, the brush head base 130 is flat metal plate in the shape of a circle. It is contemplated that the shape of the brush head base 130 is not limited to the shape of a circle, and that any shape may be utilized. The brush head base 130 is formed with a plurality of attachment points, a first broom head mounting point 131, a second broom head mounting point 134, and a spring mounting point 138. The first brush head mounting point 131 and second brush head mounting point 134 are collinear with the spring mounting point 138 located on a line perpendicular from each of the brush mounting points. At the center of the brush head base 130, handle mount 140 is fixedly attached to the brush head base 130. The handle mount 140 protrudes normal from the surface of the brush head base 130 and subsequently angles at a twenty-two (22) degree angle before terminating. The end of the handle mount 140 opposite the fixed end is formed with a threaded bore 142.

The first brush head 110 includes a base 111 with bristles 112 fixedly attached and extending normal therefrom. The bristles 112 are made of a firm, flexible and durable material such as polyethylene terephthalate (PET), polypropylene, or any other material having similar physical characteristics and properties. The physical characteristics and properties of the bristles 112 may be modified to accommodate different surfaces and uses. Harder bristles are used for heavy duty cleaning and softer bristles for use on more sensitive surfaces. The base 111 of the first broom head 110 may be sized according to the use of the double action push broom 10. For larger cleaning surface areas, the first brush head 110 may be made larger, and for cleaning smaller areas made smaller.

The base 111 has a perimeter edge defined by a first edge 180, second edge 182, third edge 184, and fourth edge 186. In the preferred embodiment the base is substantially rectangular. The base 111 is further formed with a mounting hole 114 adjacent the fourth edge 186 of the base 111. The first brush head 110 is rotatably connected to the brush head base 130 at mounting hole 114. The fourth edge 186 of the base 111 has a straight section 188 followed by a curved section 189. The mounting hole 114 provides a mounting point in which a fastener 133 may be rigidly attached to the first brush head 110. The first brush head 110 is mounted to the brush head base 130 through the use of the fastener 133. A sleeve bearing 132 is inserted into the first brush mounting point 131 of the brush head base and the fastener 133 is inserted through the sleeve bearing 132 and the mounting hole 114 of the base 111 of the first brush head 110. The fastener passes through the mounting hole 114 and subsequently threaded into a corresponding nut 118 and tightened. The sleeve bearing 132 provides a low-friction surface in which the fastener smoothly rotates about with ease, thereby allowing the first brush head 110 to rotate with ease. Alternatively, the sleeve bearing 132 may be placed within the mounting hole 114 of the first brush head 110. It is contemplated that the use of the sleeve bearing 132 is not meant to be limiting and various other types of bearings may be used without departing form the scope and spirit of the invention. Alternatively, the first brush head mounting point 131 may be finished to provide a smooth, low-friction surface removing the need to have a sleeve bearing 132.

The second brush head 120 is substantially similar to the first brush head 110 and includes all of the same structures. The second brush head 120 has a base 121 formed with a mounting hole 124 and a perimeter edge defined by a first edge 190, a second edge 192, a third edge 194, and a fourth edge 196. The fourth edge 196 includes a straight section 198 followed by a curved section 199. Bristles 122 are fixedly attached to the base 121 and extend normal therefrom. The second brush head 120 is attached to the brush head base 130 through the use of a fastener 136 which is inserted through a sleeve bearing 135 which is inserted into the second brush head mounting point 134 and subsequently through the base 121 of the second brush head 120 at the mounting hole 124. A nut 128 is threaded over the fastener 136 and tightened to hold the second brush head to the fastener 136.

The first and second brush head 110 and 120, respectively, are rotatably attached to the brush head base 130 at a predetermined position which allows the bristles 112 and 122 to overlap at the edges. The first and second brush head 110 and 120, respectively, are placed adjacent with the fourth edge 186 and the fourth edge 196 in contact. This ensures that there are no large gaps in which debris may pass through. Further, the positioning of the first brush head 110 relative to the second brush head 120 creates a clearance gap which allows the first brush head 110 and the second brush head 120 to rotate independent from another. However, the fourth edge 186 of the first brush head 110 and the fourth edge 196 of the second brush head 120 controls the maximum brush angle 160 shown in FIG. 1. The maximum brush angle 160 is controlled by the straight sections 188 and 198 of the fourth edge 186 and 196, respectively. The curved sections 189 and 199 allow the first brush head 110 and second brush head 120 to rotate relative to one another. The first brush head 110 and the second brush head 120 rotates until the straight sections 188 and 198 come into contact thereby preventing further rotation. In the preferred embodiment, the maximum brush angle 160 is one-hundred eighty (180) degrees. The curved sections 189 and 199 allow the first brush head 110 and the second brush head 120 to rotate inward, decreasing the brush angle 160.

In the preferred embodiment, a torsion spring 150, having a spring coil 156 terminating at a first moment arm 152 and a second moment arm 154, is rigidly attached to the brush head base 130. The first moment arm 152 is rigidly attached to the first brush head 110 and the second moment arm 154 is rigidly attached to the second brush head 120. In the preferred embodiment, the spring 150 is a helical torsion spring. However, as discussed above the use of the torsion spring is not meant to be limiting. The helical torsion spring 150 is a metal rod or wire coiled in the shape of a helix that is subjected to twisting about the axis of the coil by sideways forces applied to its ends, twisting the coil tighter. The spring subsequently stores mechanical energy when it is twisted. When the coil is twisted, it exerts a force in the opposite direction proportional to the amount it is twisted.

The torsion spring 150 in the preferred embodiment is constructed with a predetermined resting angle between the first moment arm 152 and the second moment arm 154 and a predetermined spring constant. For heavy duty cleaning applications, a larger spring constant may be desirable whereas for light cleaning a smaller spring constant may be desirable. Similarly, for smaller sweeping motions a smaller resting angle between the first moment arm 152 and the second moment arm 154 may be desirable and for a larger sweeping motion the resting angle may be smaller. However, it is contemplated that the spring constant and resting angle is different for different applications and may be varied without departing from the scope and spirit of the invention.

The torsion spring 150 is rigidly attached to the brush head base 130 through the use of a retainer 158 and retainer fastener 159. The retainer 158 is placed over a coil of the spring coil 156 and is fastened in place by the fastener 159 which is threaded into the spring mounting point 138 formed on the brush head base 130. This ensures that the torsion spring 150 is rigidly in place. In the preferred embodiment, the torsion spring 150 is fixedly attached to the brush head base 130 where the axis of the spring is substantially at the center of the brush head base 130. The torsion spring 150 is positioned to allow the first moment arm 152 to attach to the first brush head 110 and the second moment arm 154 to attach to the second brush head 120 at a substantially similar distance from the axis of rotation of each brush. This allows the force of the torsion spring 150 to be equally distributed between the first brush head 110 and the second brush head 120.

A handle 170 having a threaded end 172 corresponding with the threads of the threaded bore 142 is attached to the dynamic double action dual brush head 100. The handle 170 is threadably received by the threaded bore 142 of the handle mount 140. As a result, the handle 170 extends from the dynamic double action dual brush head 100 at a twenty-two (22) degree angle. The twenty-two (22) degree angle allows a person to grip the handle and apply adequate force to the attached dynamic double action dual brush head 100 to push and sweep. It is contemplated, however, that a twenty-two (22) degree angle is not meant to be limiting. Various other angles may be contemplated and used depending on the user's needs without departing for scope and spirit of the invention.

Figure 3:
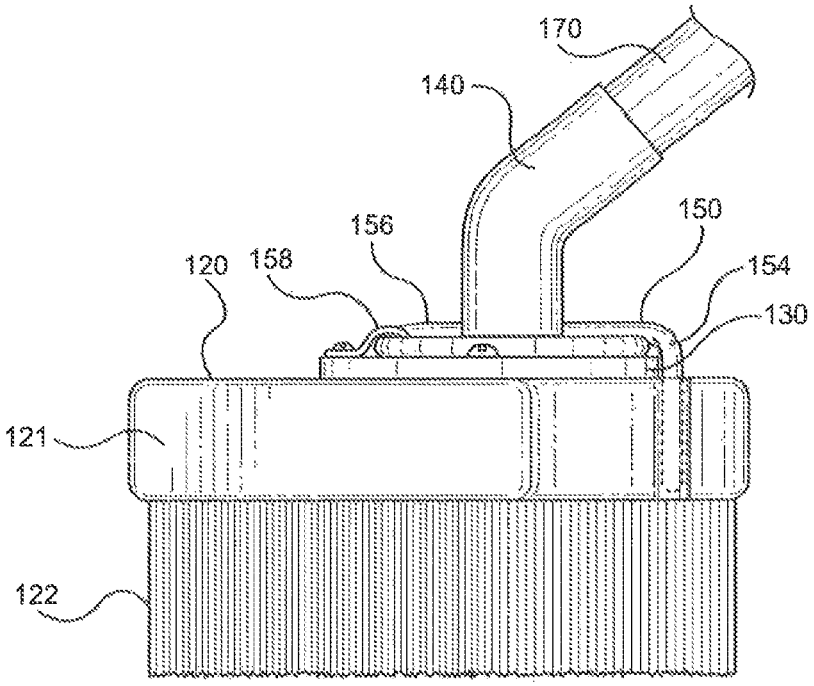
FIG. 3 is a side view of the dynamic double action dual brush head.
Figure 4:
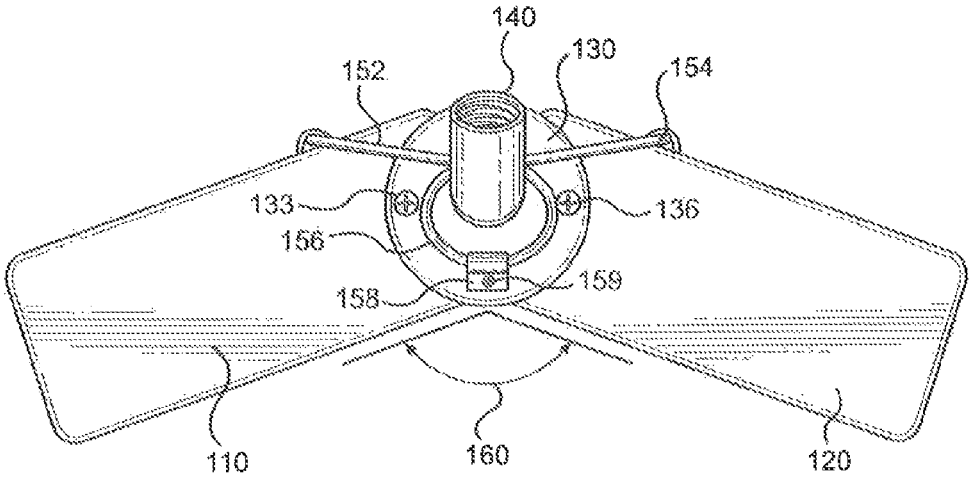
FIG. 4 is a top view of the dynamic double action dual brush head.
Figure 6:
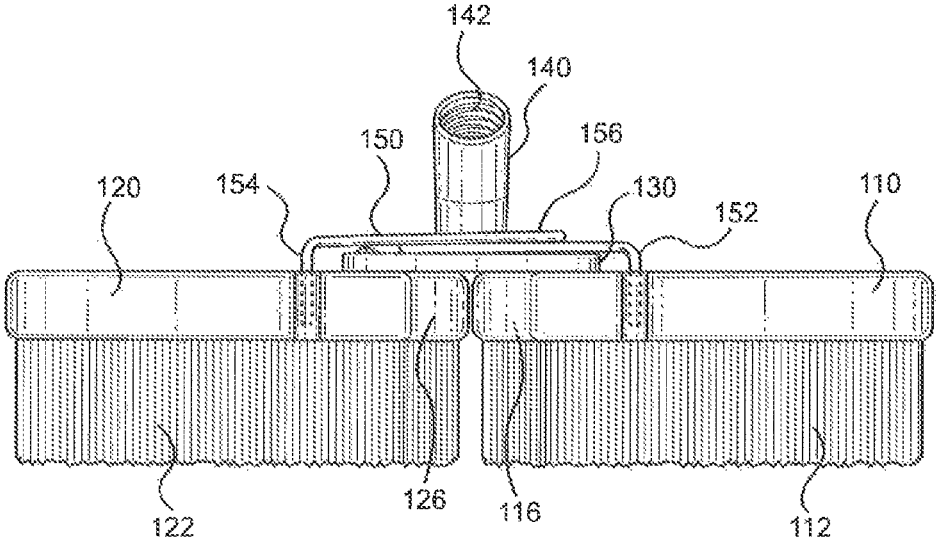
FIG. 6 is a back view of the dynamic double action dual brush head.

Referring now to FIG. 3, a side view of the dynamic double action dual brush head 100 is shown. The second moment arm 154 of the tension spring 150 is rigidly attached to the second brush head 120. The second moment arm 154 is attached to the second brush head 120 through the use of an adhesive. However, it is contemplated that various other methods of attachment may be used to attach the second moment arm 154 to the second brush head 120 such as a fastener, or a receiver formed in the second brush head 120 may be used to retain the second moment arm 154. As shown in FIG. 4 and FIG. 6, the first moment arm 152 is attached to the first brush head 110 using a similar method and structure. Referring back to FIG. 3, the handle mount 140 bends at a twenty-two (22) degree angle from the surface of the brush head base 130. The handle 170 is threadably received by the handle mount 140 and also positioned at a twenty-two (22) degree angle form the surface of the brush head base 130. This allows a user to grip the handle and apply adequate force to push the broom and sweep the floor.

Referring now to FIG. 4, a top view of the brush head is shown. As shown, the spring coil 156 of the torsion spring 150 is rigidly attached to the brush head base 130 with the first moment arm 152 attached to the first brush head 110 and the second moment arm 154 attached to the second brush head 120. At rest, the brush angle 160 is equal to the rest angle of the torsion spring 150.

Figure 5:
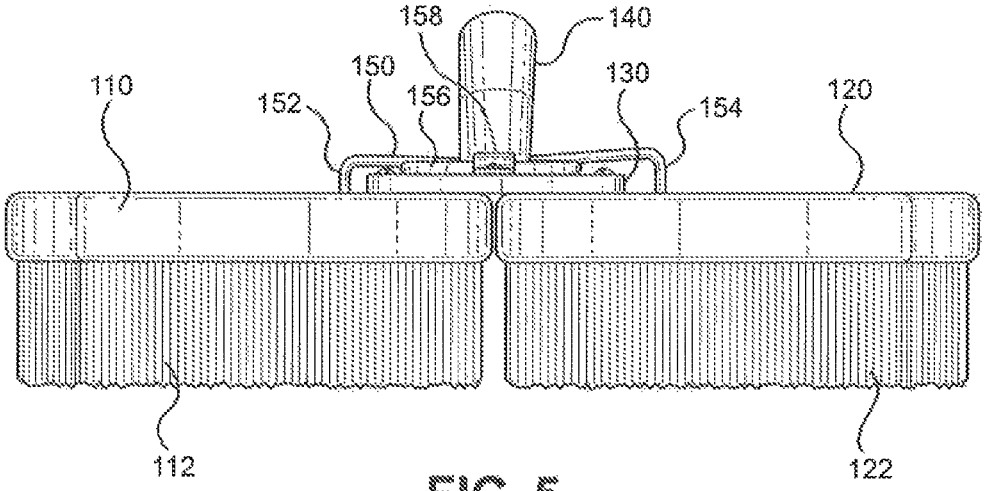
FIG. 5 is a front view of the dynamic double action dual brush head.

Referring now to FIG. 5, a front view of the dynamic double action dual brush head 100 is shown. The dynamic double action dual brush head 100 includes a first brush head 110 and a second brush head 120. The bristles 112 of the first brush head 110 and the bristles 122 of the second brush head 120 intertwine together to create a tight brush surface for the dynamic double action dual brush head 100. This ensures no large gaps are present in the brush surface in which debris may slip past.

Referring now to FIG. 6, a back view of the dynamic dual brush head 100 is shown. As shown the handle mount 140 has a threaded bore 142 corresponding with the threaded end 172 of the handle 170. This allows the handle 170 to thread into and out of the threaded bore 142 to allow the replacement of either the handle 170 or the dynamic double action dual brush head 100 in situations where either part is damaged.

Figure 7:
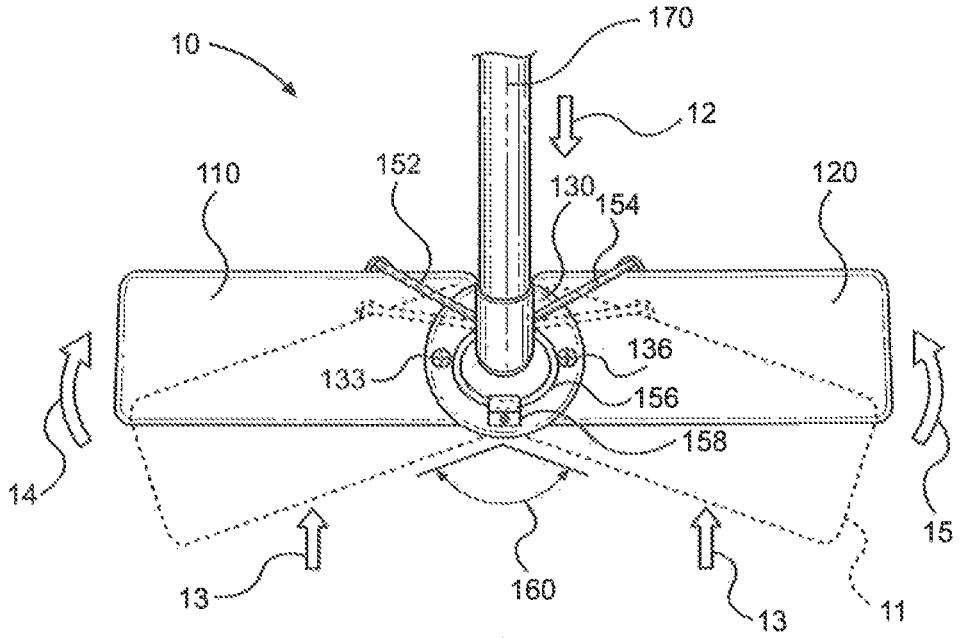
FIG. 7 is top view of the dynamic double action dual brush head broom in use with the dynamic double action dual brush head rotated to its maximum brush angle.

Referring now to FIG. 7, the double action push broom 10 is shown pushed in a forward direction 12 by a user. Before a user begins pushing the double action push broom 10, the double action push broom 10 is at rest and the brush angle 160 between the first brush head 110 and second brush head 120 is at its original angle at rest position 11. As the user begins pushing the double action push broom 10, the force exerted by the user is transferred from the broom handle 170 to the bristles 112 and 122 of the first and second brush head 110 and 120, respectively.

Due to the twenty-two (22) degree angle of the broom handle 170, the force has a vertical and horizontal component. The horizontal component of the force pushes the broom towards direction 12 while the vertical component creates friction between the bristles 112 and 122 of the first and second brush 110 and 120 and the surface being swept. The friction counteracts the horizontal component of the force by producing an opposite force 13. However, as the user applies more force, the friction is eventually overcome and the broom 10 begins to advance in direction 12. The counteracting force 13 acts on the first brush head 110 and the second brush head 120 thereby rotating the first brush head 110 and the second brush head 120 along their respective axis of rotation.

The counteracting force 13 rotates the first brush head 110 in direction 14 and second brush head 120 in direction 15 along its axis of rotation. Provided an adequate amount of counteracting force 13 is present, the first brush head 110 and second brush head 120 may rotate until the maximum brush angle 160 is achieved. In the preferred embodiment, the maximum brush angle 160 is one-hundred eighty (180) degrees. At its maximum brush angle 160, the straight sections 188 and 198 of the first brush head 110 and second brush head 120 come into contact to prevent further rotation, providing a straight brush with the longest available width. As discussed above, the maximum brush angle 160 may be varied to meet the requirements of the broom 10.

Figure 8:
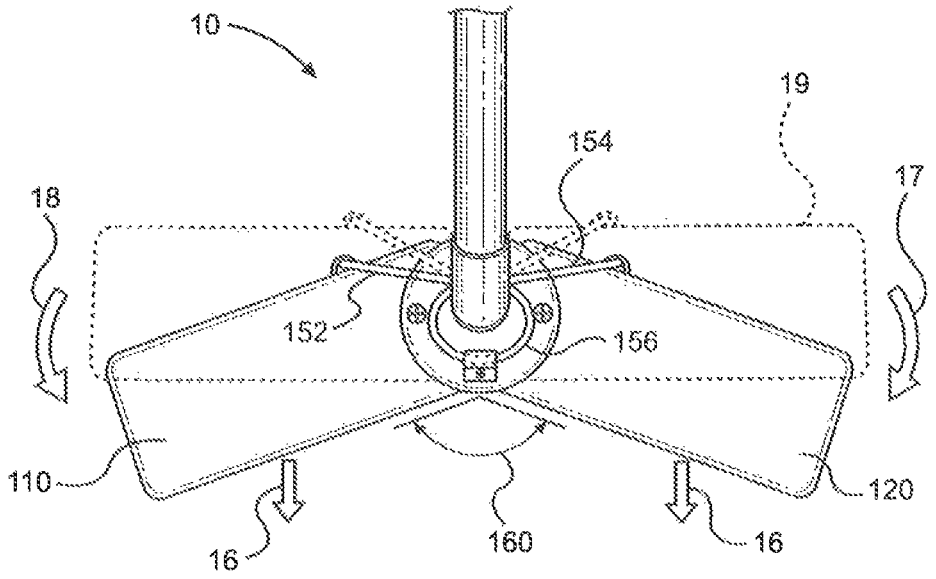
FIG. 8 is a top view of the dynamic double action dual brush head broom after a complete sweep stroke with the dynamic dual brush head reverting back to its rest angle.

As shown in FIG. 8, once the user stops moving the broom 10 in direction 12 and the force stops, the mechanical potential energy of the torsion spring 150 is released and transferred back into the dynamic double action dual brush head 100, providing force 16 and rotating the first brush head 110 in direction 18 and second brush head 120 in direction 17 along its respective axis of rotation to the initial rest angle of the dynamic double action dual brush head 100. The conversion of force from potential to kinetic energy results in the rotation of the dynamic double action dual brush head 100 from its prior position 19 to its original angle at position 11, creating the additional sweeping motion which dramatically improves the effectiveness of the double action push broom 10 over traditional push brooms.

The additional dynamic movement of the double action push broom 10 provides an additional sweeping motion which traditional push brooms are not capable of performing. Further, the dynamic motion of the dynamic dual brush head 100 sweeps the dirt towards the center of the broom allowing easier collection of dirt and dust. Additionally, with traditional push brooms, dirt tends to be collected towards the ends of the broom. With the dynamic motion of the dynamic dual brush head 100, the dirt at the ends swept up and pushed towards the center. Further, the force exerted by the spring releases any trapped debris from the bristles 112 and 122, providing a cleaner push broom for the next sweep.

Figure 9:
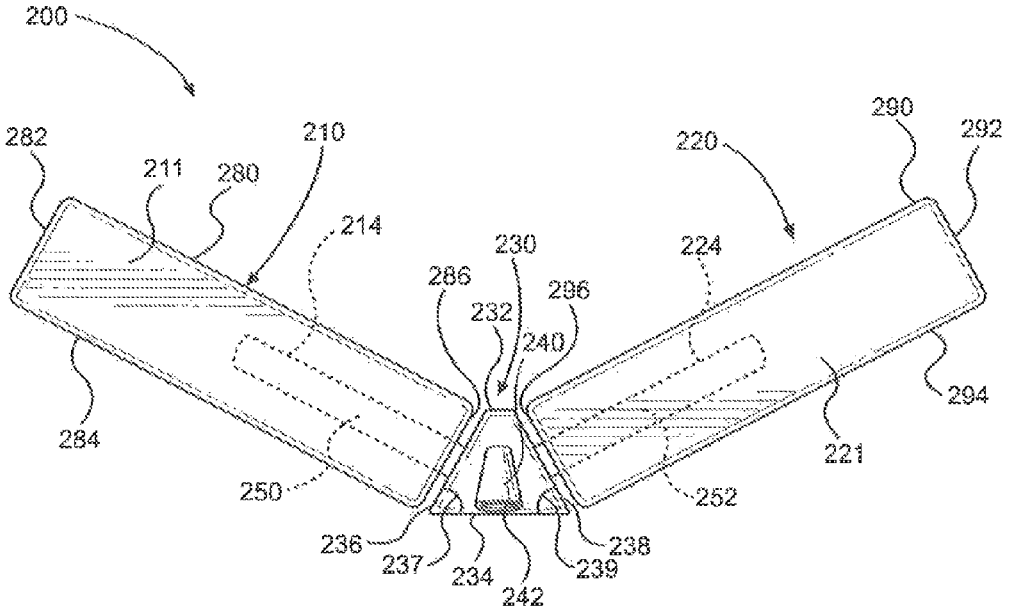
FIG. 9 is a top view of an alternative embodiment of the dynamic double action dual brush head.

Referring now to FIG. 9, an alternative embodiment of the dynamic double action dual brush head of the present invention is shown and generally designated 200. The dynamic double action dual brush head 200 includes two separate brush heads, a first brush head 210 and a second brush head 220 rotatably connected to a brush head base 230.

In the preferred embodiment of the dynamic double action dual brush head 200, the brush head base 230 is a base having the shape of a trapezoid with a top edge 232, a bottom edge 234, a first side edge 236, and a second side edge 238. The top edge 232 and the bottom edge 234 are parallel. The first edge 236 is formed at an angle 237 and the second edge 238 is formed at an angle 239 with the same measure, thereby forming an isosceles trapezoid. At the center of the brush head base 230, handle mount 240 is fixedly attached to the brush head base 230. Formed on the base 230, opposite the handle mount are bristles. The handle mount 240 protrudes normal from the surface of the brush head base 230 and subsequently angles at a twenty-two (22) degree angle before terminating. The end of the handle mount 240 opposite the fixed end is formed with a threaded bore 242.

Formed perpendicular on the side of the first side edge 236 is a first arm 250 and formed perpendicular on the side of the second side edge 238 is a second arm 252. The first arm 250 and the second arm 252 are made of an elastic material with a high stiffness that would allow for slight deformation while being able to return to its original shape. The type of elastic material used may be rubbers, polyethylene, PTFE, HDPE, polypropylene, PET, certain metals, or any other material having similar physical characteristics and properties. By using the elastic material with a high stiffness, the first arm 250 and the second arm 252 may deflect under a certain amount of force and return to its original shape once that force is removed. The first arm 250 and the second arm 252 are the mechanical energy storage devices. By attaching a first brush head 210 to the first arm 250 and second brush head 220 to the second arm 252, the first brush head 210 and the second brush head 220 is able to provide the extra sweeping motion as described above.

The first brush head 210 includes a base 211 with bristles fixedly attached and extending normal therefrom. The base 211 has a perimeter edge defined by a first edge 280, second edge 282, third edge 284, and fourth edge 286. In the preferred embodiment the base 211 is substantially rectangular. The base 211 is further formed with a mounting hole 214 adjacent the fourth edge 286 and extending into the base 211. The first arm 250 is mounted to the mounting hole 214 where the first arm 250 provides the pivot point for the first brush head 210.

The second brush head 220 is substantially similar to the first brush head 210 and includes all of the same structures. The second brush head 220 includes a base 221 with bristles fixedly attached and extending normal therefrom. The base 221 has a perimeter edge defined by a first edge 290, second edge 292, third edge 294, and fourth edge 296. In the preferred embodiment the base 221 is substantially rectangular. The base 221 is further formed with a mounting hole 224 adjacent the fourth edge 296 and extending into the base 221. The second arm 252 is mounted to the mounting hole 224 where the second arm 252 provides the pivot point for the second brush head 220.

The first and second brush head 210 and 220, respectively, are pivotably attached to the brush head base 230 at a predetermined position which allows the bristles on the first brush head 210 and the bristles on the second brush head 220 to overlap the bristles on the brush head base 230 at the edges. The first and second brush head 210 and 220, respectively, are placed adjacent with the base 230 where the fourth edge 286 contacts the first side edge 236 and the fourth edge 296 is in contact with the second side edge 238. This ensures that there are no large gaps in which debris may pass through. Further, the positioning of the first brush head 210 relative to the second brush head 220 allows the first brush head 210 and the second brush head 220 to pivot independent from another.

Figure 10:
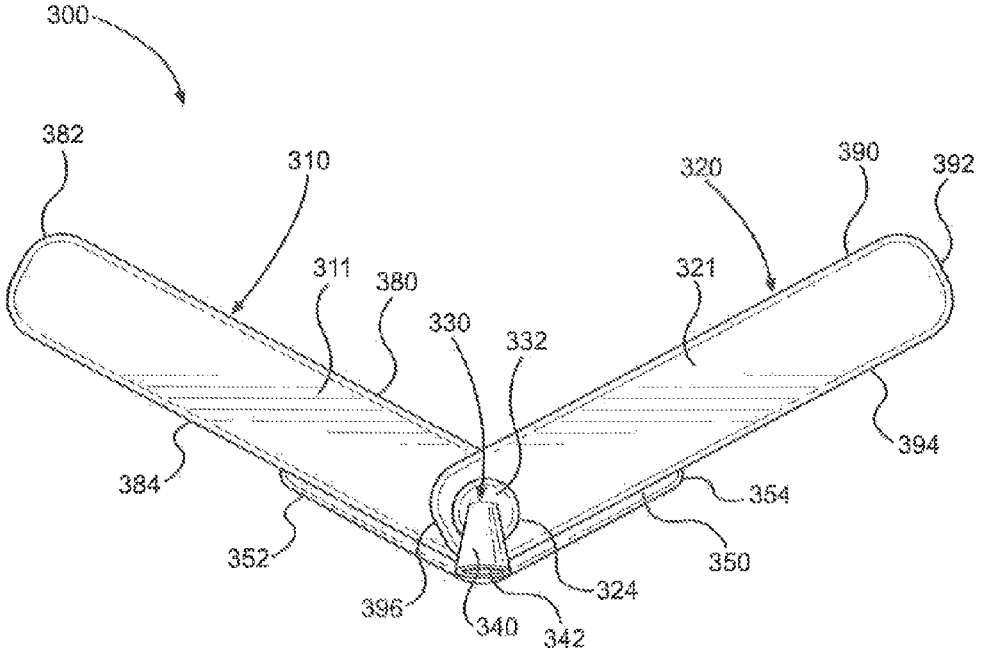
FIG. 10 is a top view of an alternative embodiment of the dynamic double action dual brush head.

Referring now to FIG. 10, an alternative embodiment of the dynamic dual action double brush head of the present invention is shown and generally designated 300. The dynamic double action dual brush head 300 includes two separate brush heads, a first brush head 310 and a second brush head 320 rotatably connected to a brush head base 330.

In the preferred embodiment of the dynamic double action dual brush head 300, the brush head base 330 is a base having the shape of a circle with an upper mounting surface 332 and a lower mounting surface. The upper mounting surface 332 and the lower mounting surface are formed adjacent and may pivot independent from one another. The upper mounting surface 332 and the lower mounting surface have a minimum and maximum rotation angle. At the center of the brush head base 330, handle mount 340 is fixedly attached to the brush head base 330. The handle mount 340 protrudes normal from the surface of the brush head base 330 and subsequently angles at a twenty-two (22) degree angle before terminating. The end of the handle mount 340 opposite the fixed end is formed with a threaded bore 342.

The first brush head 310 includes a base 311 with bristles fixedly attached and extending normal therefrom. The base 311 has a perimeter edge defined by a first edge 380, second edge 382, third edge 384, and fourth edge. In the preferred embodiment the base 311 is substantially rectangular, with the fourth edge slightly curved. The base 311 is further formed with a mounting hole adjacent the fourth edge and extending through the base 311. The lower mounting surface of the brush head base 330 is mounted to the mounting hole where the lower mounting surface provides the pivot point for the first brush head 310.

The second brush head 320 is substantially similar to the first brush head 310 and includes all of the same structures. The second brush head 320 includes a base 321 with bristles fixedly attached and extending normal therefrom. The base 321 has a perimeter edge defined by a first edge 390, second edge 392, third edge 394, and fourth edge 396. In the preferred embodiment the base 321 is substantially rectangular, with the fourth edge 396 slightly curved. The base 321 is further formed with a mounting hole 324 adjacent the fourth edge 396 and extending through the base 321. The upper mounting surface 332 of the brush head base 330 is mounted to the mounting hole 324 where the upper mounting surface 332 provides the pivot point for the second brush head 320.

The first and second brush head 310 and 320, respectively, are pivotably attached to the brush head base 330 at a predetermined position which allows the bristles on the first brush head 310 and the bristles on the second brush head 320 to overlap. Due to the first brush head 310 attached to the lower mounting surface of the brush head base 330, the second brush head 320 overlaps the first brush head 310. To provide a smooth surface for which the second brush head 320 may pivot relative to the first brush head 310, the section of the base 321 which overlaps the first brush head 310 is devoid of bristles. Alternatively, if the second brush head 320 was mounted to the lower mounting surface, then sections of the first brush head 310 would be devoid of bristles. This further ensures that there are no large gaps in which debris may pass through. Further, the positioning of the first brush head 310 relative to the second brush head 320 allows the first brush head 310 and the second brush head 320 to pivot independent from another.

Attached to the first brush head 310 and the second brush head 320 is a mechanical energy storage device 350 having a first arm 352 attached to the first brush head 310 and a second arm 354 attached to the second brush head 320. In a preferred embodiment, the mechanical energy storage device 350 is made of an elastic material with a high stiffness that would allow for slight deformation while being able to return to its original shape. The type of elastic material used may be rubbers, polyethylene, PTFE, HDPE, polypropylene, PET, certain metals, or any other material having similar physical characteristics and properties. By using the elastic material with a high stiffness, the first arm 352 and the second arm 354 may deflect under a certain amount of force and return to its original shape once that force is removed. By attaching the first brush head 310 to the first arm 352 and second brush head 320 to the second arm 354, the first brush head 310 and the second brush head 320 are able to provide the extra sweeping motion as described above.

Figure 11:
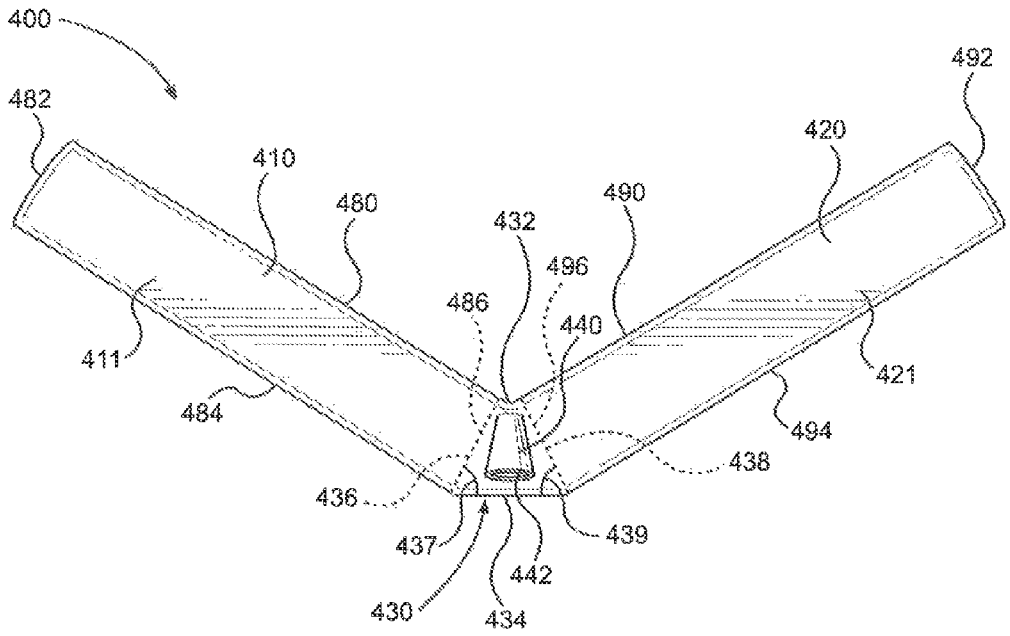
FIG. 11 is a top view of an alternative embodiment of a dynamic double action brush head.

Referring now to FIG. 11, a dynamic double action brush head of the present invention is shown and generally designated 400. The dynamic double action brush head 400 includes a base 430 having a first arm 410 and a second arm 420 integrally formed with the base 430.

In the preferred embodiment of the dynamic double action brush head 400, the base 430 has a trapezoid shape with an exposed top edge 432 and bottom edge 434. The first side edge 436 and the second side edge 438, designated by dashed lines, have the first arm 410 and second arm 420 integrally formed and protruding from the first side edge 436 and second side edge 438, respectively. The top edge 432 and the bottom edge 434 are parallel. The first edge 436 is formed at an angle 437 and the second edge 438 is formed at an angle 439 with the same measure, thereby forming an isosceles trapezoid. At the center of the base 430, handle mount 440 with a threaded bore 442 is formed into the base 430.

The first arm 410 includes a base 411 with bristles fixedly attached and extending normal therefrom. The base 411 has a perimeter edge defined by a first edge 480, second edge 482, third edge 484, and fourth edge 486 integrally formed into the first side edge 436 of the base 430. In the preferred embodiment the base 411 is substantially rectangular. The second arm 420 is substantially similar to the first arm 410 and includes all of the same structures. The second arm 420 includes a base 421 with bristles fixedly attached and extending normal therefrom. The base 421 has a perimeter edge defined by a first edge 490, second edge 492, third edge 494, and fourth edge 496 integrally formed into the second side edge 438 of the base 430. In the preferred embodiment the base 421 is substantially rectangular. Bristles are fixedly attached to and extending normal from the base 430. This ensures that an entire single surface of the dynamic double action brush head 400 is covered with bristles and that there are no large gaps in which debris may pass through.

The base 430, the first arm 410 and the second arm 420 are made of an elastic material with a high stiffness that would allow for slight deformation while being able to return to its original shape. The type of elastic material used may be rubbers, polyethylene, PTFE, HDPE, polypropylene, PET, certain metals, or any other material having similar physical characteristics and properties. By using the elastic material with a high stiffness, the first arm 410 and the second arm 420 may deflect under a certain amount of force and return to its original shape once that force is removed. The material of the base 430, the first arm 410 and the second arm 420 allows the first arm 410 and the second arm 420 to deflect thereby storing mechanical energy. As the force is removed the mechanical energy is released and the first arm 410 and the second arm return to its original orientation, thereby providing the extra sweeping motion.

Figure 12:
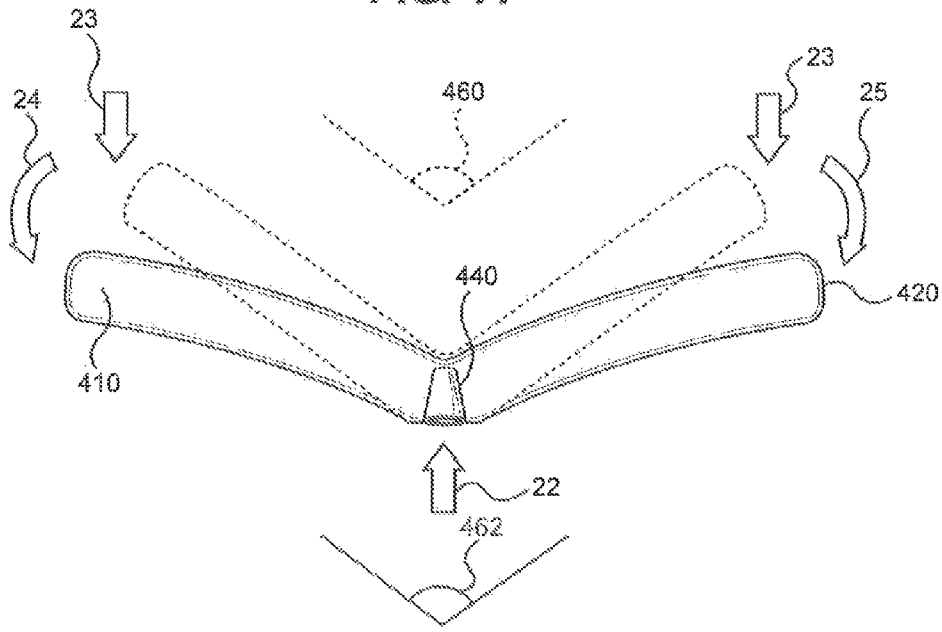
FIG. 12 is a top view of the alternative embodiment of a dynamic double action brush head of FIG. 11 in use with the dynamic double action brush head at its maximum brush angle.

Referring now to FIG. 12, the dynamic dual action brush head 400 is pushed in direction 22. As the dynamic dual action brush head 400 is pushed in direction 22, the bristles and the surface being swept create a friction force 23. As the user applies more force in direction 22, the friction 23 is eventually overcome and the dynamic dual action brush head 400 begins to advance in direction 22. The friction force 23 acts on the first arm 410 and the second arm 420 thereby pivoting the first arm 410 and the second arm 420 along their respective axis.

The friction force 23 rotates the pivots the first arm 410 in direction 24 and the second arm 420 in direction 25. Provided an adequate amount of friction force 23 is present, the first arm 410 and the second are 420 may rotate from a minimum brush angle 460 until a maximum brush angle 462 is achieved. In the preferred embodiment, the maximum brush angle 462 is one-hundred eighty (180) degrees. The maximum brush angle 462 may be varied to meet the requirements of the dynamic dual action brush head 400.

While there have been shown what are presently considered to be preferred embodiments of the present invention, it will be apparent to those skilled in the art that various changes and modifications can be made herein without departing from the spirit and scope of the invention.

I claim:

1. A double action dual brush head comprising:
- a brush head base comprising a base formed with a first brush head mounting point, a second brush head mounting point, and a torsion spring mounting point;
- a first brush head rotatably attached to said brush head base, said first brush head comprising:
  - a base having a perimeter edge defined by a first edge, a second edge, a third edge, and a fourth edge, wherein said fourth edge has a straight section and a curved section,
  - a plurality of bristles fixedly attached to the bottom of said base, and
  - a mounting hole formed into said base, adjacent said fourth edge;
- a second brush head rotatably attached to said brush head base, said second brush head comprising:
  - a base having a perimeter edge defined by a first edge, a second edge, a third edge, and a fourth edge, wherein said fourth edge has a straight section and a curved section,
  - a plurality of bristles fixedly attached to the bottom of said base, and
  - a mounting hole formed into said base, adjacent said fourth edge; and
- a torsion spring attached to said brush head base, and said torsion spring also attached to both said first brush head and said second brush head;
- a first fastener placed through said first brush head mounting paint of said brush head base and through said mounting hole of said first brush head, rotatably connecting said first brush head to said brush head base;
- a second fastener placed through said second brush head mounting point of said brush head base and through said mounting hole of said second brush head, rotatably connecting said second brush head to said brush head base; and
- a means to attach said torsion spring to said torsion spring mounting point.

2. The double action dual brush head of claim 1, wherein said brush head base further comprises a handle mount having a threaded bore fixedly attached to said base of said brush head base.

3. The double action dual brush head of claim 1, wherein said torsion spring comprises a loop, a first moment arm, and a second moment arm.

4. A double action push broom comprising:
- a double action dual brush head having:
  - a brush head base comprising a base formed with a first brush head mounting point, a second brush head mounting point, and a mechanical energy storage device mounting point,
  - a first brush head rotatably attached to said brush head base, said first brush head comprising:

a base having a perimeter edge defined by a first edge, a second edge, a third edge, and a fourth edge, wherein said fourth edge has a straight section and a curved section:

a plurality of bristles fixedly attached to the bottom of said base; and a mounting hole formed into said base, adjacent said fourth edge, a second brush head rotatably attached to said brush head base, said second brush head comprising:

a base having a perimeter edge defined by a first edge, a second edge, a third edge, and a fourth edge, wherein said fourth edge has a straight section and a curved section;

a plurality of bristles fixedly attached to the bottom of said base; and a mounting hole formed into said base, adjacent said fourth edge, a mechanical energy storage device attached to said brush head base, and said mechanical energy storage device also attached to both said first brush head and said second brush head, a first fastener placed through said first brush head mounting point of said brush head base and through said mounting hole of said first brush head, rotatably connecting said first brush head to said brush head base, a second fastener placed through said second brush head mounting point of said brush head base and through said mounting hole of said second brush head, rotatably connecting said second brush head to said brush head base, and a means to attach said mechanical energy storage device to said mechanical energy storage device mounting point.

5. The double action push broom of claim 4, wherein said brush head base further comprises a handle mount having a threaded bore fixedly attached to said base of said brush head base.

6. The double action dual-brush push broom of claim 5, wherein said first brush head mounting point and said second brush head mounting point are aligned collinear, and said mechanical energy storage device mounting point is aligned perpendicular to said first broom head mounting point and second broom head mounting point.

7. The double action push broom of claim 6, wherein said mechanical energy storage device is a torsion spring having a loop, a first moment arm, and a second moment arm.

8. The double action push broom of claim 7, wherein said loop of said torsion spring is attached to said brush head base, said first moment arm of said torsion spring is attached to said first brush head, and said second moment arm of said torsion spring is attached to said second brush head.

9. The double action push broom of claim 8, further comprising a broom handle removably attached to said double action brush head.

10. The double action push broom of claim 9, wherein said push broom handle is formed with corresponding threads to be received by said threaded bore of said handle mount.

11. A double action push broom comprising:

a double action dual brush head comprising a brush head base comprising a base formed with a first brush head mounting point, a second brush head mounting point, and a spring mounting point, a first brush head attached to said brush head base, said first brush head comprising:

a base having a perimeter edge defined by a first edge, a second edge, a third edge, and a fourth edge, wherein said fourth edge has a straight section and a curved section; and a mounting hole formed into said base, adjacent said fourth edge, a second brush head attached to said brush head base, said second brush head comprising:

a base having a perimeter edge defined by a first edge, a second edge, a third edge, and a fourth edge, wherein said fourth edge has a straight section and a curved section; and a mounting hole formed into said base, adjacent said fourth edge, a spring attached to said brush head base, and said spring is also attached to both said first brush head and said second brush head, a first fastener placed through said first brush head mounting point of said brush head base and through said mounting hole of said first brush head, rotatably connecting said first brush head to said brush head base;

a second fastener placed through said second brush head mounting point of said brush head base and through said mounting hole of said second brush head, rotatably connecting said second brush head to said brush head base, and a means to attach said spring to said spring mounting point, wherein said first brush head and second brush head are independently moveable.

12. The double action push broom of claim 11, further comprising a broom handle removably attached to said double action dual brush head.

* * * * *